US006938897B1

(12) United States Patent
Napiorkowski

(10) Patent No.: US 6,938,897 B1
(45) Date of Patent: Sep. 6, 2005

(54) UNIVERSAL ROLE PLAYING GAME ELEVATION INDICATOR SYSTEM

(76) Inventor: Walter C. Napiorkowski, 212 13th Ave. North, St. Cloud, MN (US) 56303

( * ) Notice: Subject to any disclaimer, the term of this patent is extended or adjusted under 35 U.S.C. 154(b) by 0 days.

(21) Appl. No.: 10/884,319

(22) Filed: Jul. 2, 2004

(51) Int. Cl.[7] ..... A63B 71/00
(52) U.S. Cl. ..... 273/148 R; 434/202
(58) Field of Search ..... 273/148 R

(56) References Cited

U.S. PATENT DOCUMENTS

| | | | | |
|---|---|---|---|---|
| 5,153,826 | A * | 10/1992 | Johnson | 700/91 |
| 5,527,033 | A * | 6/1996 | Puma et al. | 273/148 R |
| 5,871,487 | A * | 2/1999 | Warner et al. | 606/130 |
| 6,259,889 | B1 * | 7/2001 | LaDue | 434/308 |
| 6,454,651 | B1 * | 9/2002 | Yoseloff | 463/25 |
| 6,614,451 | B1 * | 9/2003 | Hudson et al. | 345/759 |
| 6,628,302 | B2 * | 9/2003 | White et al. | 345/717 |
| 2002/0028705 | A1 * | 3/2002 | Kelly | 463/2 |
| 2002/0035790 | A1 * | 3/2002 | Barton | 33/1 SB |
| 2002/0172927 | A1 * | 11/2002 | Faulkner | 434/202 |
| 2003/0094759 | A1 * | 5/2003 | Niedner et al. | 273/255 |
| 2004/0157194 | A1 * | 8/2004 | Libby | 434/128 |

FOREIGN PATENT DOCUMENTS

DK EP001262213 A1 * 5/2001 ..... A63F 13/02

OTHER PUBLICATIONS

Heroclix, Wizkidsgames.com, Website printout, Jun. 19, 2004, 1 page.

* cited by examiner

*Primary Examiner*—Gregory Vidovich
*Assistant Examiner*—Dolores R. Collins

(57) ABSTRACT

A universal role playing game elevation indicator system for efficiently indicating elevation measurements of playing pieces used in role playing games. The universal role playing game elevation indicator system includes a support member having a lower end and an upper end, a plurality of multiplication indicia and elevation indicia positioned upon the support member, a first band movably positioned about the support member for indicating the multiplication rate of a character's elevation number, and a second band movably positioned about the support member for indicating the elevation of a character. The support member is comprised of an elongated and straight structure. The upper end is flat and level for receiving a figurine representing the character. The support member has a cross sectional size small enough to fit within a space upon a game board.

17 Claims, 6 Drawing Sheets

UNIVERSAL ROLE PLAYING GAME ELEVATION INDICATOR SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to role playing games and more specifically it relates to a universal role playing game elevation indicator system for efficiently indicating elevation measurements of playing pieces used in role playing games.

2. Description of the Related Art

Role playing games have been in use for years. Examples of role playing games include DUNGEONS & DRAGONS®, WARHAMMER®, GURPS®, MAGE-KNIGHTS®, HERO CLICKS® and other fantasy adventure games.

Typically, in role playing games, miniature playing pieces are used to portray a character (e.g. player, monster). These characters are able to attain different elevations during the enactment of the role playing games.

One problem with these role playing games is the inability of players to quickly determine the elevation for each particular character at a given time. Because this can affect the range of attacks, magical effects, and movement of the characters, it is an important factor within the game and is subject to changing during the game. Inability to quickly determine the elevation of a playing piece often leads to uncertainty, slowing down the game and misrepresentation as to the accurate elevation of a character playing piece. Prior objects to impart that a playing piece was elevated included a piece of paper underneath, a pop can, and other objects that did not purport a true and actual elevation, only that the playing piece was elevated.

While these devices may be suitable for the particular purpose to which they address, they are not as suitable for indicating elevation measurements of playing pieces used in role playing games. Role playing games do not have an efficient system for monitoring character elevation.

In these respects, the universal role playing game elevation indicator system according to the present invention substantially departs from the conventional concepts and designs of the prior art, and in so doing provides an apparatus primarily developed for the purpose of indicating elevation measurements of playing pieces used in role playing games.

BRIEF SUMMARY OF THE INVENTION

In view of the foregoing disadvantages inherent in the known types of role playing games now present in the prior art, the present invention provides a new universal role playing game elevation indicator system construction wherein the same can be utilized for efficiently indicating elevation measurements of playing pieces used in role playing games.

To attain this, the present invention generally comprises a support member having a lower end and an upper end, a plurality of multiplication indicia and elevation indicia positioned upon the support member, a first band movably positioned about the support member for indicating the multiplication rate of the elevation number, and a second band movably positioned about the support member for indicating the elevation number of a character. The support member is comprised of an elongated and straight structure. The upper end is flat and level for receiving a figurine representing the character. The support member has a cross sectional size small enough to fit within a space upon a game board.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a universal role playing game elevation indicator system that will overcome the shortcomings of the prior art devices.

A second object is to provide a universal role playing game elevation indicator system for efficiently indicating elevation measurements of playing pieces used in role playing games.

Another object is to provide a universal role playing game elevation indicator system that discourages cheating among players.

An additional object is to provide a universal role playing game elevation indicator system that reduces uncertainty during play.

A further object is to provide a universal role playing game elevation indicator system that is capable of being utilized with various types of figurines.

Another object is to provide a universal role playing game elevation indicator system that may be utilized with various role playing games.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
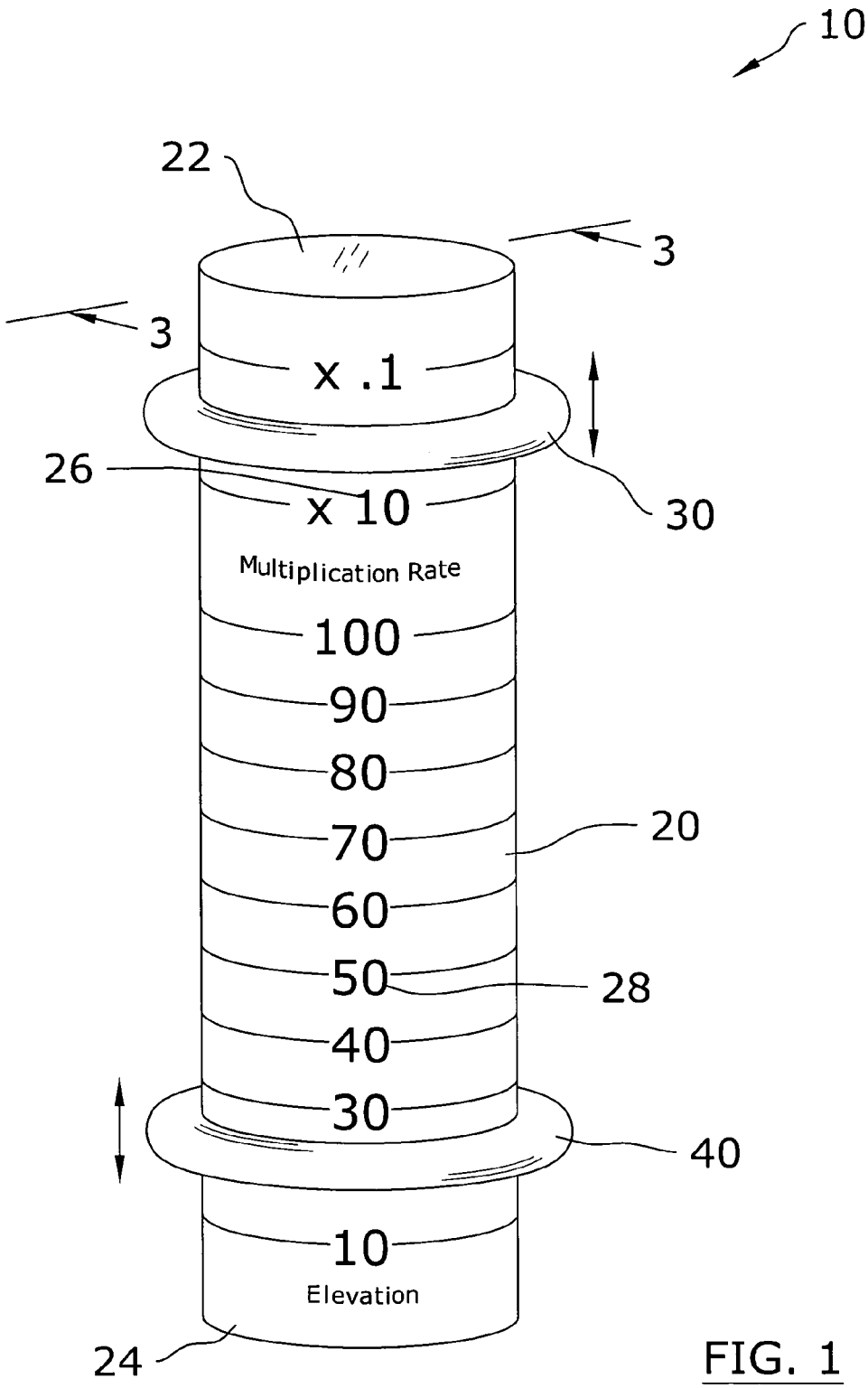
FIG. 1 is an upper perspective view of the present invention.

Turning now descriptively to the drawings, in which similar reference characters denote similar elements throughout the several views, FIGS. 1 through 6 illustrate a universal role playing game elevation indicator system 10, which comprises a support member 20 having a lower end 24 and an upper end 22, a plurality of multiplication indicia 26 and elevation indicia 28 positioned upon the support member 20, a first band 30 movably positioned about the support member 20 for indicating the multiplication rate of the elevation indicia 28, and a second band 40 movably positioned about the support member 20 for indicating the elevation of a character. The support member 20 is comprised of an elongated and straight structure. The upper end 22 is flat and level for receiving a figurine 12 representing the character. The support member 20 has a cross sectional size small enough to fit within a space upon a game board.

B. Support Member

The support member 20 is preferably comprised of an elongated straight structure having a lower end 24 and an upper end 22 as shown in FIGS. 1 through 6 of the drawings. The support member 20 preferably has a circular cross sectional shape having approximately a one-inch diameter, however various other cross sectional shapes may be utilized such as but not limited to square, oval and the like. The applicant has found that a one-inch diameter is able to fit within most spaces upon a role playing game's board. The support member 20 preferably has a height of at least four-inches though less height may be utilized.

Figure 4:
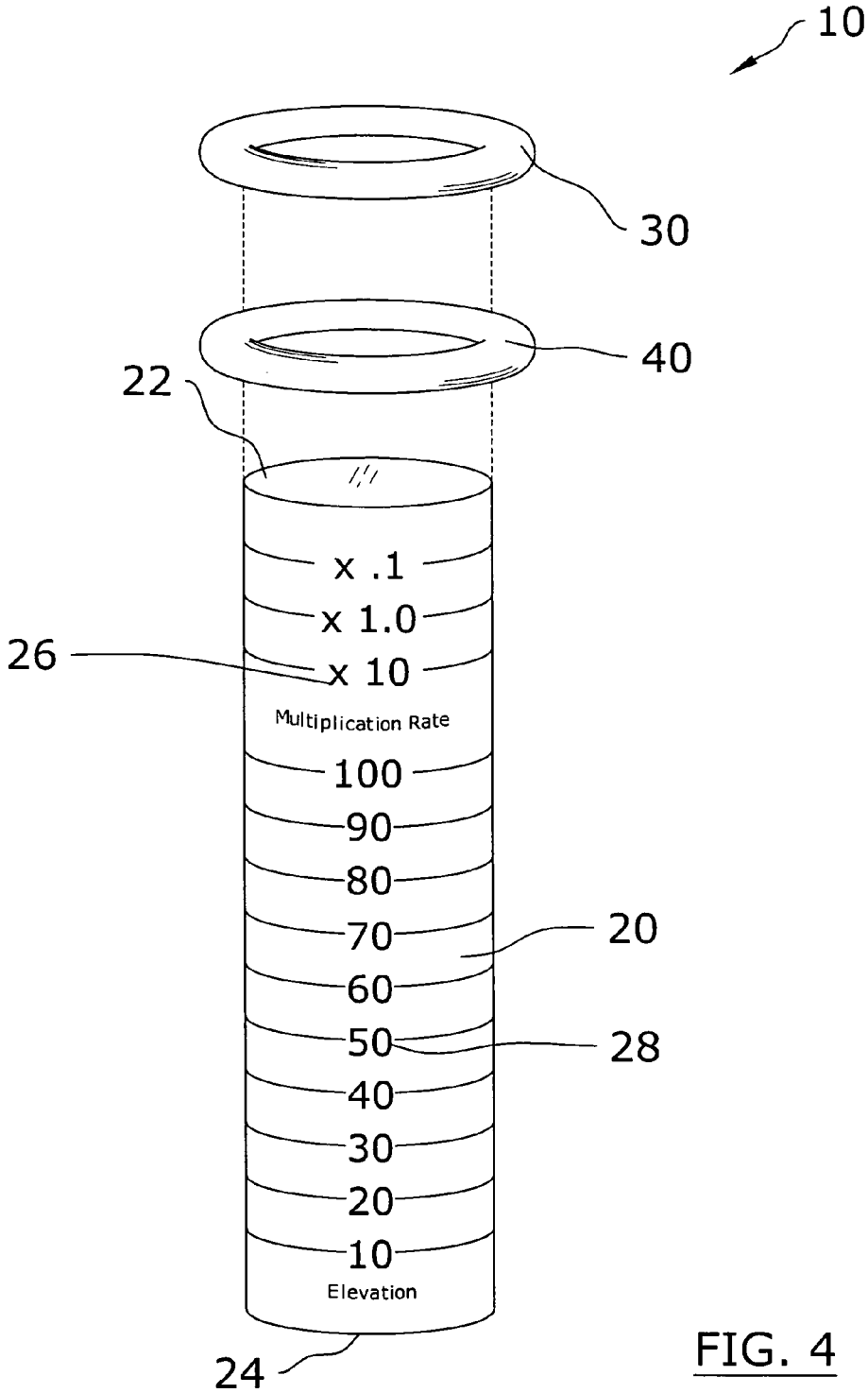
FIG. 4 is an exploded upper perspective view of the present invention.
Figure 5:
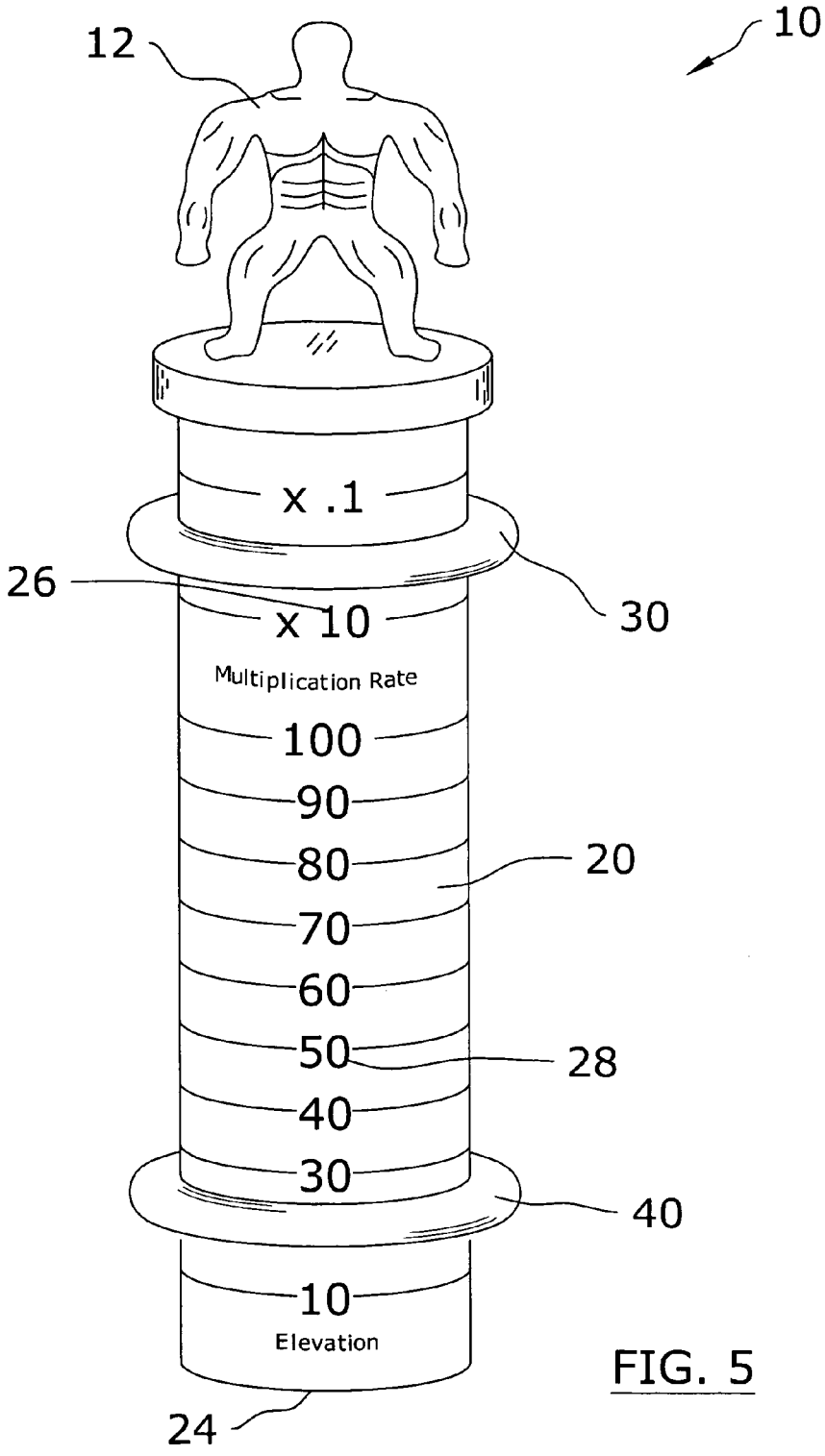
FIG. 5 is an upper perspective view of the present invention with a figurine positioned upon an upper end thereof.
Figure 6:
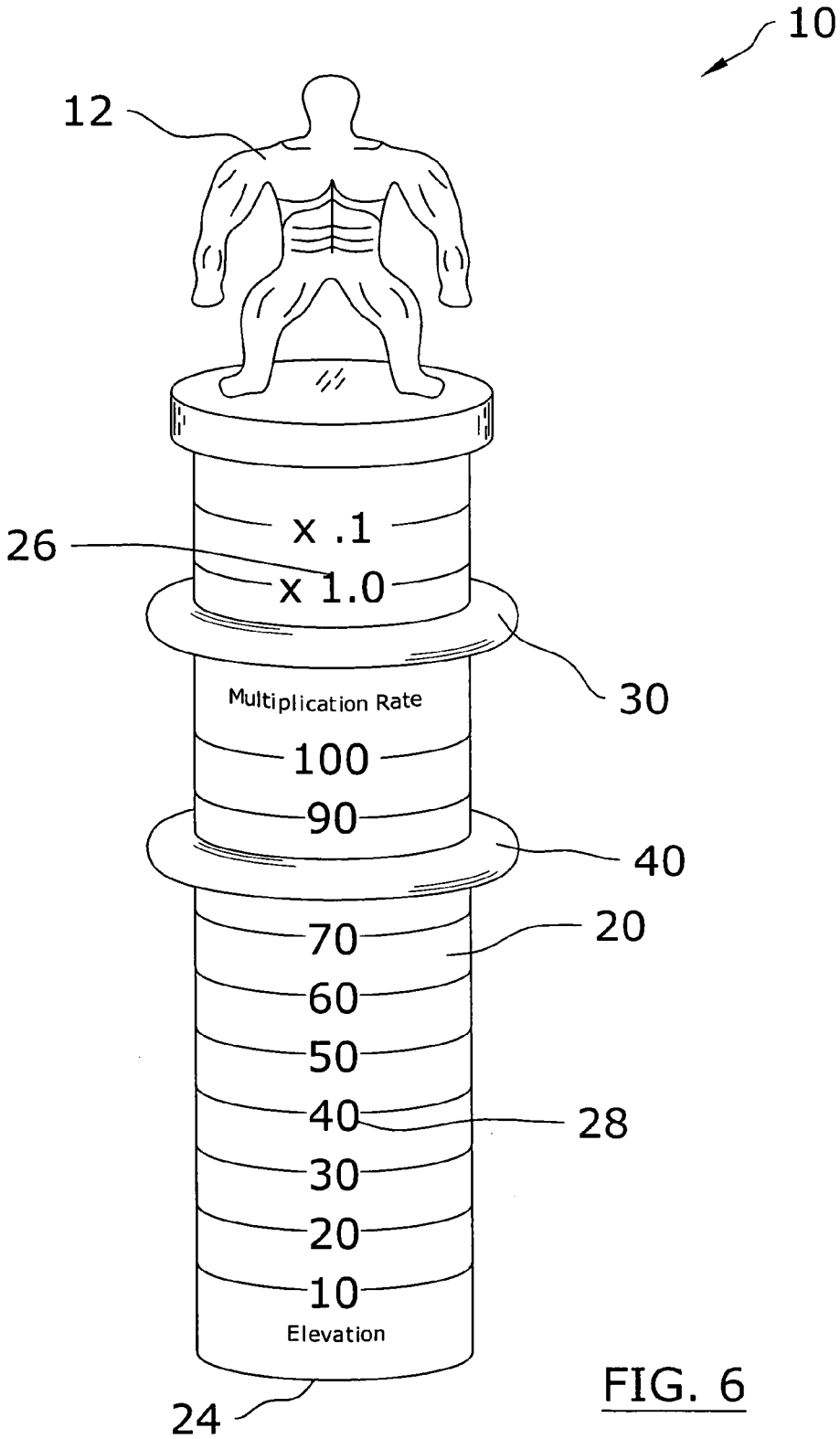
FIG. 6 is an upper perspective view of the present invention with the first band and the second band moved to represent the elevation of the character.

As shown in FIGS. 1 and 4 of the drawings, the upper end 22 of the support member 20 is preferably flat and level for receiving a figurine 12. FIGS. 5 and 6 illustrate a figurine 12 positioned upon the upper end 22 of the support member 20. The lower end 24 is also preferably flat and substantially parallel to the upper end 22 to provide adequate support to the support member 20 when positioned upon a game board.

The support member 20 is preferably comprised of a solid structure, though non-solid structures may also be utilized. The support member 20 is preferably comprised of an acrylic or plastic material, though other materials may be utilized.

C. Indicia

Figure 2:
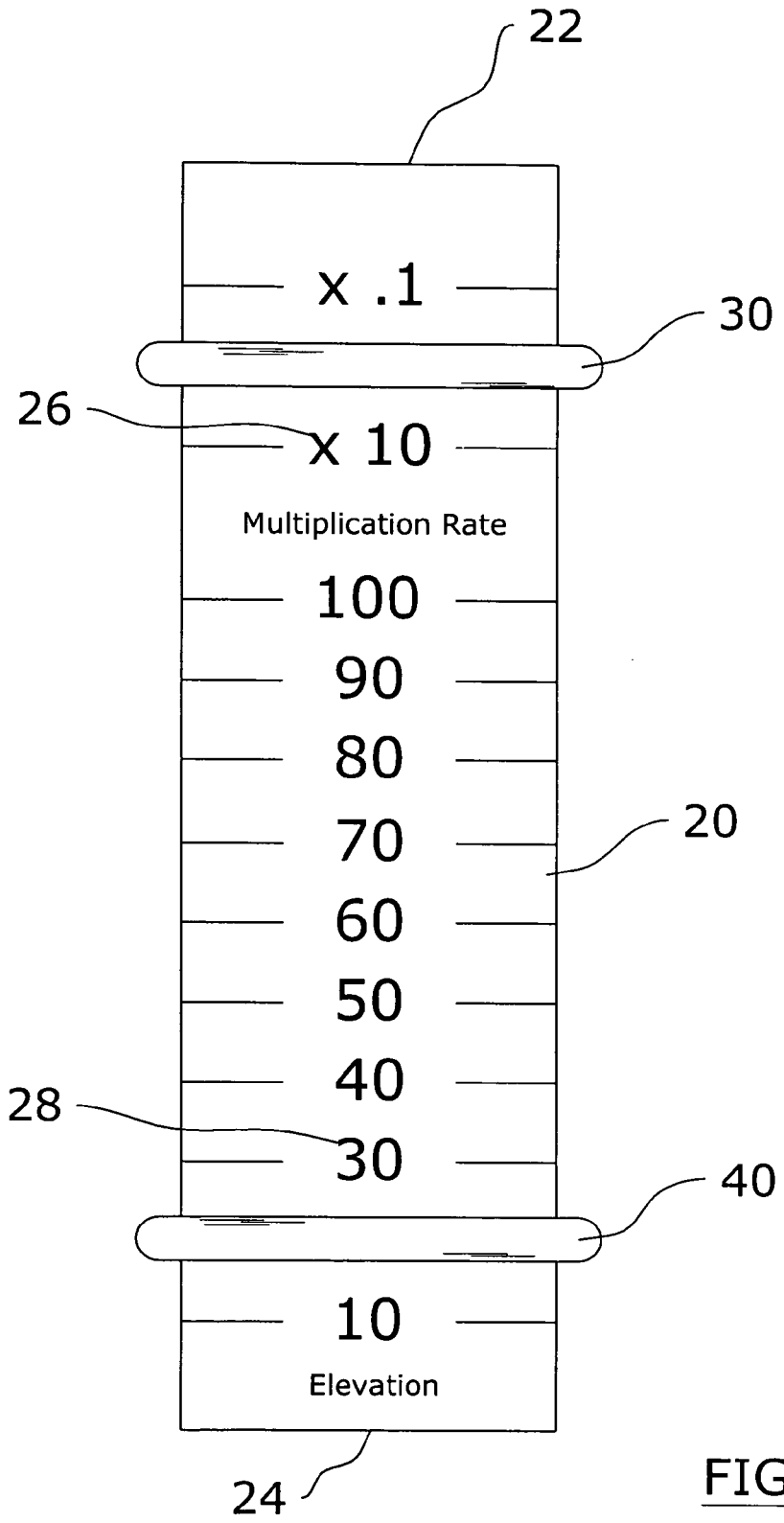
FIG. 2 is a front view of the present invention.
Figure 3:
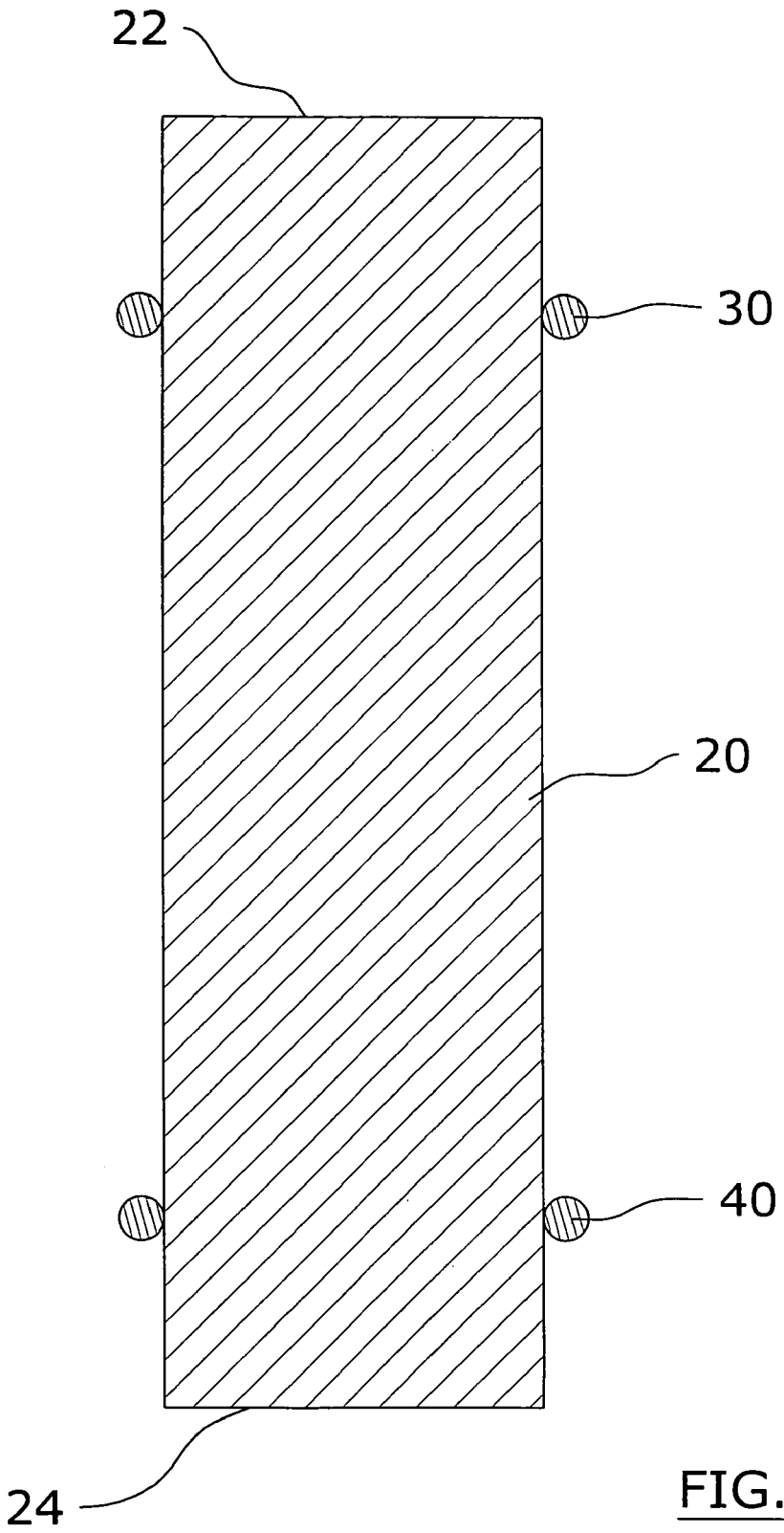
FIG. 3 is a cross sectional view taken along line 3—3 of FIG. 1.

The plurality of multiplication indicia 26 are positioned upon the support member 20 as shown in FIGS. 1, 2 and 4 of the drawings. The multiplication indicia 26 preferably include a plurality of horizontal lines with a multiplication rate within each of the horizontal lines. The multiplication indicia 26 may be painted, engraved, attached to a label or applied in a related manner to the support member 20. The multiplication indicia 26 may be in various units such as but not limited to 0.1, 1.0, 10.

The elevation indicia 28 are positioned upon the support member 20 as further shown in FIGS. 1, 2 and 4 of the drawings. The elevation indicia 28 preferably include a plurality of horizontal lines with an elevation within each of the horizontal lines. The elevation indicia 28 may be painted, engraved, attached to a label or applied in a related manner to the support member 20. As shown in FIGS. 1, 2 and 4 of the drawings, the multiplication indicia 26 are preferably positioned above the elevation indicia 28, though the elevation indicia 28 may be positioned above the multiplication indicia 26. The elevation indicia 28 may be in feet, yards or meters. The elevation indicia 28 may also be represented in various formats such as by increments of 10 (e.g. 10, 20, 30, etc.).

The multiplication indicia 26 are utilized for multiplying the elevation indicia 28. For example, if the multiplication indicia 26 is set to X 0.1 and the elevation indicia 28 is set to 20 (feet, yards, etc.), the actual elevation of a character would be 2.0. If the multiplication indicia 26 is set to X 10 and the elevation indicia 28 is set to 20, the actual elevation of a character would be 200 (feet, yards, etc.). If the multiplication indicia 26 is set to X 1.0 and the elevation indicia 28 is set to 20, the actual elevation of a character would be 20 (feet, yards, etc.).

D. Bands

The first band 30 is movably positioned about the support member 20 for indicating a multiplication rate of elevation indicia 28. The second band 40 is movably positioned about the support member 20 for indicating an elevation of a character.

The first band 30 and the second band 40 are each comprised of an elastic material, though materials having other properties may be utilized. The first band 30 and the second band 40 may have various thicknesses and colors.

E. Operation of Invention

In use, the user positions the figurine 12 representing the character upon upper end 22 of the support member 20 as shown in FIGS. 5 and 6 of the drawings. The first band 30 and the second band 40 are positioned upon the support member 20 to represent the character's initial elevation. For example, if the character initially has a 20 foot elevation, the first band 30 is initially set to the "X1" multiplication indicia 26 and the second band 40 is set to the "20" as shown in FIGS. 1 and 5 of the drawings. The players then play the role playing game as they normally would. If the character's elevation is increased to 200 for example, the second band 40 is set to the "20" elevation indicia 28 and the first band 30 is set to the "X10" multiplication indicia 26. During each player's turn, the first band 30 and the second band 40 are adjusted to reflect their respective character's elevation.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A universal role playing game elevation indicator system, comprising:

a support member having a lower end and an upper end, wherein said support member is comprised of a unitary elongated and straight structure, and wherein said support member has a circular cross sectional shape;

wherein said support member has a lower section and an upper section above said lower section;

a plurality of multiplication indicia positioned upon said upper section of said support member, wherein said multiplication indicia include a plurality of horizontal lines with a multiplication rate within each of said horizontal lines;

a plurality of elevation indicia positioned upon said lower section of said support member, wherein said elevation indicia include a plurality of horizontal lines with an elevation within each of said horizontal lines;

a first band movably positioned about and surrounding said support member for indicating a multiplication rate of a character's elevation; and a second band movably positioned about and surrounding said support member for indicating an elevation of a character, wherein said first band and said second band are each comprised of an elastic material.

2. The universal role playing game elevation indicator system of claim 1, wherein said support member has approximately a one-inch diameter.

3. The universal role playing game elevation indicator system of claim 1, wherein said support member has a height of at least four-inches.

4. The universal role playing game elevation indicator system of claim 1, wherein said upper end is flat and level for receiving a figurine.

5. The universal role playing game elevation indicator system of claim 1, wherein said lower end is flat and substantially parallel to said upper end.

6. The universal role playing game elevation indicator system of claim 1, wherein said support member is comprised of a solid structure.

7. The universal role playing game elevation indicator system of claim 1, wherein said support member is comprised of acrylic or plastic.

8. A universal role playing game elevation indicator system, comprising:

a support member comprised of an elongated straight structure having a lower end and an upper end, wherein said support member has a circular cross sectional shape having approximately a one-inch diameter and wherein said support member has a height of at least four-inches;

wherein said upper end of said support member is flat and level for receiving a figurine;

a plurality of multiplication indicia positioned upon said support member, wherein said multiplication indicia include a plurality of horizontal lines with a multiplication rate within each of said horizontal lines;

elevation indicia positioned upon said support member, wherein said elevation indicia include a plurality of horizontal lines with an elevation within each of said horizontal lines;

a first band movably positioned about and surrounding said support member for indicating a multiplication rate for a character's elevation; and a second band movably positioned about and surrounding said support member for indicating an elevation of a character, wherein said first band and said second band are each comprised of an elastic material.

9. The universal role playing game elevation indicator system of claim 8, wherein said lower end is flat and substantially parallel to said upper end.

10. The universal role playing game elevation indicator system of claim 8, wherein said support member is comprised of a solid structure.

11. The universal role playing game elevation indicator system of claim 8, wherein said support member is comprised of acrylic or plastic.

12. The universal role playing game elevation indicator system of claim 8, wherein said first band and said second band are each comprised of an elastic material.

13. The universal role playing game elevation indicator system of claim 8, wherein said multiplication indicia are positioned above said elevation indicia.

14. A universal role playing game elevation indicator system, comprising:

a support member having a lower end and an upper end, wherein said support member is comprised of a unitary elongated and straight structure, and wherein said support member has a circular cross sectional shape;

wherein said upper end is flat and level for receiving a figurine;

wherein said lower end is flat and substantially parallel to said upper end;

wherein said support member has a height of at least four-inches;

wherein said support member has a lower section and an upper section above said lower section;

a plurality of multiplication indicia positioned upon said upper section of said support member, wherein said multiplication indicia include a plurality of horizontal lines with a multiplication rate within each of said horizontal lines;

a plurality of elevation indicia positioned upon said lower section of said support member, wherein said elevation indicia include a plurality of horizontal lines with an elevation within each of said horizontal lines;

a first band movably positioned about and surrounding said support member for indicating a multiplication rate of a character's elevation; and a second band movably positioned about and surrounding said support member for indicating an elevation of a character, wherein said first band and said second band are each comprised of an elastic material.

15. The universal role playing game elevation indicator system of claim 14, wherein said support member has approximately a one-inch diameter.

16. The universal role playing game elevation indicator system of claim 14, wherein said support member is comprised of a solid structure.

17. The universal role playing game elevation indicator system of claim 14, wherein said support member is comprised of acrylic or plastic.

* * * * *